US008888332B2

(12) United States Patent
Martis et al.

(10) Patent No.: US 8,888,332 B2
(45) Date of Patent: Nov. 18, 2014

(54) ACCESSORIES FOR LED LAMPS

(71) Applicant: Soraa, Inc., Fremont, CA (US)

(72) Inventors: Wilfred Martis, Fremont, CA (US); Frank Shum, Fremont, CA (US); Artem Mishin, Fremont, CA (US); Zinovy Dolgonosov, Fremont, CA (US)

(73) Assignee: Soraa, Inc., Fremont, CA (US)

( * ) Notice: Subject to any disclaimer, the term of this patent is extended or adjusted under 35 U.S.C. 154(b) by 16 days.

(21) Appl. No.: 13/909,752

(22) Filed: Jun. 4, 2013

(65) Prior Publication Data

US 2013/0322089 A1 Dec. 5, 2013

Related U.S. Application Data

(60) Provisional application No. 61/776,173, filed on Mar. 11, 2013, provisional application No. 61/655,894, filed on Jun. 5, 2012.

(51) Int. Cl.

| | |
|---|---|
| ***F21V 3/00*** | (2006.01) |
| ***F21V 5/04*** | (2006.01) |
| ***F21V 13/14*** | (2006.01) |
| ***F21V 29/00*** | (2006.01) |
| ***F21K 99/00*** | (2010.01) |
| ***F21V 17/10*** | (2006.01) |

(52) U.S. Cl.

CPC . *F21V 5/04* (2013.01); *F21V 13/14* (2013.01); *F21V 29/2293* (2013.01); *F21K 9/13* (2013.01); *F21V 17/105* (2013.01)

USPC ..... 362/311.02; 362/398; 248/206.5

(58) Field of Classification Search

CPC ..... F21V 17/102; F21V 5/04; F21V 17/105; F21K 9/13

USPC ..... 362/311.02, 398; 248/206.5

See application file for complete search history.

(56) References Cited

U.S. PATENT DOCUMENTS

| | | | | |
|---|---|---|---|---|
| 3,283,143 | A * | 11/1966 | Gosnell | 362/317 |
| 3,621,233 | A * | 11/1971 | Ferdinand et al. | 362/355 |
| 4,225,904 | A * | 9/1980 | Linder | 362/510 |
| 5,005,109 | A * | 4/1991 | Carleton | 362/509 |
| 6,889,006 | B2 * | 5/2005 | Kobayashi | 396/6 |
| 7,997,774 | B2 * | 8/2011 | Liddle | 362/398 |
| 8,651,711 | B2 * | 2/2014 | Rudisill et al. | 362/398 |
| 8,746,918 | B1 * | 6/2014 | Rubino | 362/139 |
| 8,752,975 | B2 * | 6/2014 | Rubino | 362/139 |

* cited by examiner

*Primary Examiner* — Ali Alavi

(74) *Attorney, Agent, or Firm* — Kilpatrick Townsend & Stockton LLP

(57) ABSTRACT

Apparatus and methods of attaching accessories to LED lamps and for providing active accessories in LED lamps are disclosed.

18 Claims, 9 Drawing Sheets

ACCESSORIES FOR LED LAMPS

This application claims the benefit under 35 U.S.C. §119 (e) of U.S. Provisional Application No. 61/776,173 filed on Mar. 11, 2013, and U.S. Provisional Application No. 61/655,894 filed on Jun. 5, 2012, each of which is incorporated by reference in its entirety.

FIELD

The disclosure relates to the field of LED illumination and more particularly to techniques for active accessories for LED lamps.

Although the "Edison Bulb" has been prevalent for decades, the function of Edison bulb has been limited to providing one or another type of light. The introduction of halogen lamps and compact fluorescent lamps, has provided yet additional choices for consumers to choose one or another type of lamp/light, but the advances have remained limited to providing one or another type of light. With the advances in light emitting diode (LED) illumination, LED lamps offer much longer lifetimes, much more efficient lighting and other attributes that improve function and reduce overall cost of ownership. This situation provides a baseline for introducing features into LED lamps in order to still further improve the utility of LED lamps. For example, LED lamps can be fitted with passive accessories (e.g., lenses, filters, polarizers, etc.).

Accessories for standard halogen lamps such as MR16 lamps include, for example, diffusers, color filters, polarizers, linear dispersion, and baffles. Such accessories are commercially available from companies such as Abrisa, Rosco, and Lee Filters. These accessories can be used to control the quality of light including elimination of glare, to change the color temperature of the lamp, or to tailor a beam profile for a particular application.

Generally, accessories for halogen lamps are required to withstand high temperature and may be made of glass, and often require special mechanical holders or fixtures to incorporate with the halogen lamp. Often, such halogen lamp accessories require disassembly of the lamp from the fixture to incorporate into the fixture. This set of disadvantages results in the accessories having high costs and being cumbersome to install.

At the same time, miniaturized electronics have become very small, and relatively inexpensive (e.g., a charge-coupled device (CCD) camera), thus setting up opportunity to deploy miniaturized electronics adapted as active accessories in conjunction with LED lamps.

Therefore, there is a need for improved approaches and accessories for LED lamps.

SUMMARY

This disclosure relates to apparatus allowing for simple and low cost implementation of accessories for LED lamps that can be used to retrofit existing fixtures. In other words, the accessories disclosed herein are compatible with fixtures that may not have been designed to be used with such accessories. In certain embodiments, disassembly of LED lamps is not necessary for installation of the accessories.

Many of the embodiments herein address use of an active electronic component that is integrated into or used with an LED lamp. Some implement electronic circuitry in a base, and some implement electronic circuitry (including connectivity) in a "smart" adapter. Examples of such embodiments are included in the appended figures and in the description.

BRIEF DESCRIPTION OF THE DRAWINGS

Those skilled in the art will understand that the drawings, described herein, are for illustration purposes only. The drawings are not intended to limit the scope of the present disclosure.

DETAILED DESCRIPTION

The term "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

The term "or" is intended to mean an inclusive "or" rather than an exclusive "or". That is, unless specified otherwise, or is clear from the context, "X employs A or B" is intended to mean any of the natural inclusive permutations. That is, if X employs A, X employs B, or X employs both A and B, then "X employs A or B" is satisfied under any of the foregoing instances. In addition, the articles "a" and "an" as used in this application and the appended claims should generally be construed to mean "one or more" unless specified otherwise or is clear from the context to be directed to a singular form.

"Accessory" or "Accessories" includes any mechanical or electro-mechanical component or electrical component or fixture to be mated to a lamp. In certain embodiments, an accessory comprises a thin, optically transparent film, sheet, or plate.

Reference is now made in detail to certain embodiments. The disclosed embodiments are not intended to be limiting of the claims.

Figure 1:
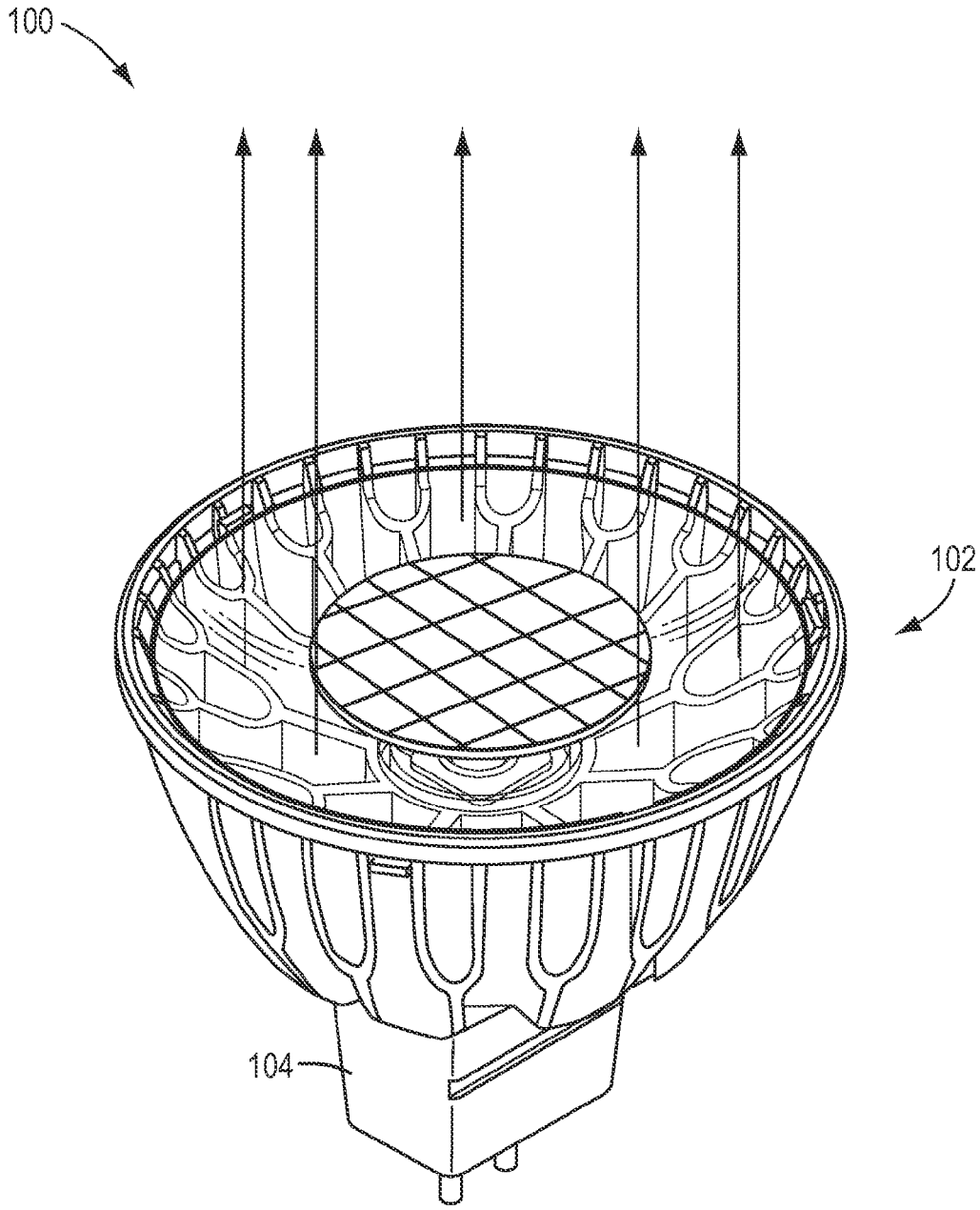
FIG. 1 shows a housing for implementing active accessories in an LED lamp, according to some embodiments.

FIG. 1 shows a housing 100 for implementing active accessories in an LED lamp. The LED lamp includes a heat sink 102 and a base 104 and light (arrows) emanating from the optic.

In some embodiments, the housing has an inner volume (center cross-hatched area) suited for situating electronic components such as power conditioning circuitry and/or microprocessors and sensors.

Figure 2:
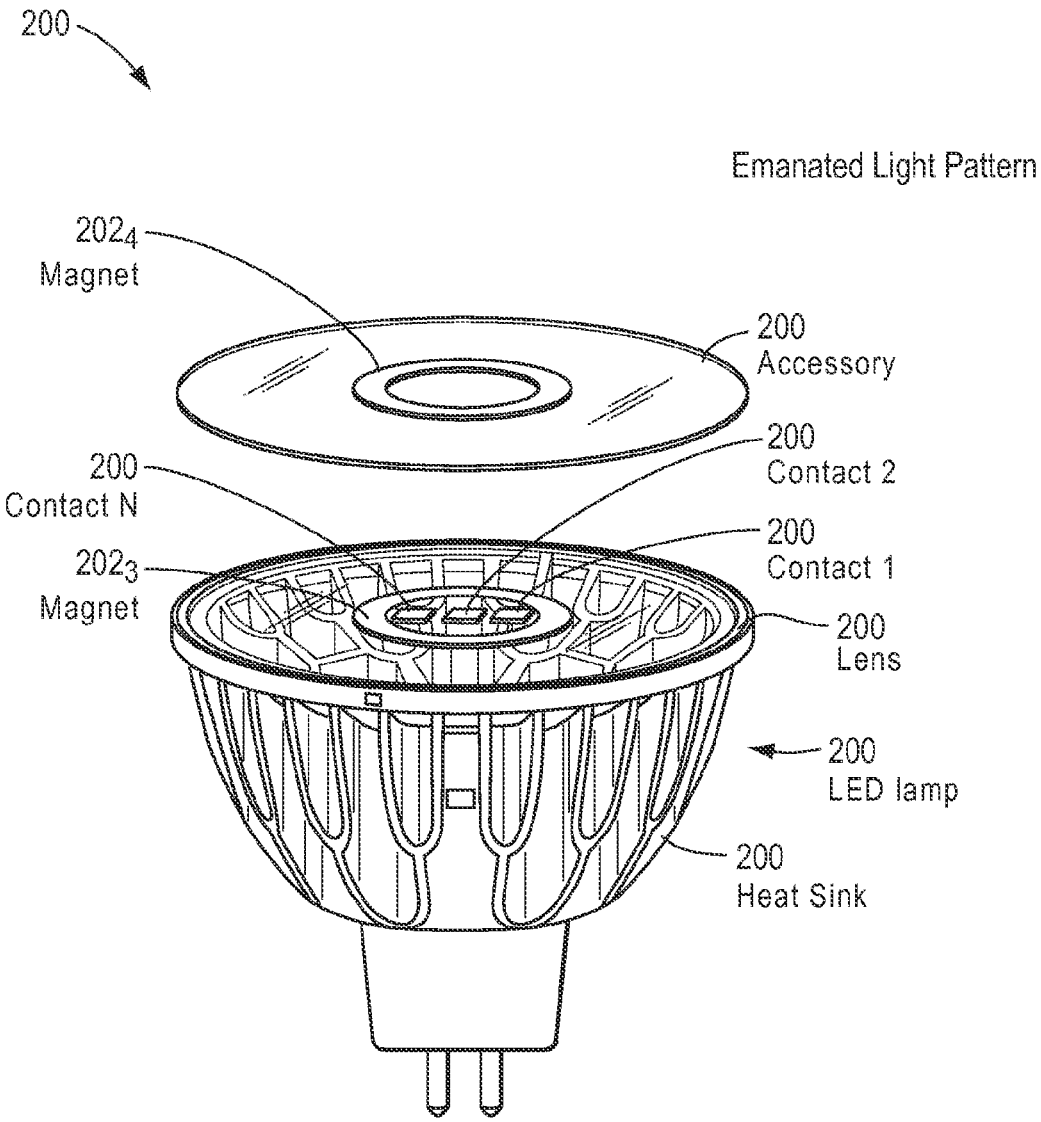
FIG. 2 shows an adapter used to provide active accessories in an LED lamp, according to some embodiments.

FIG. 2 shows an adapter 200 used to provide active accessories in an LED lamp. The LED lamp includes a heat sink, lens, magnet $\mathbf{202}_3$, magnet $\mathbf{202}_4$, an accessory, and electrical contacts N 200 (contact N, contact 1 and contact 2).

A plurality of contacts can be positioned atop the lens, and the contacts can be configured to provide an electrical connection to electronic components such as power conditioning circuitry and/or microprocessors and sensors. In some embodiments, an adapter uses magnetic forces to hold an accessory in place.

Figure 3:
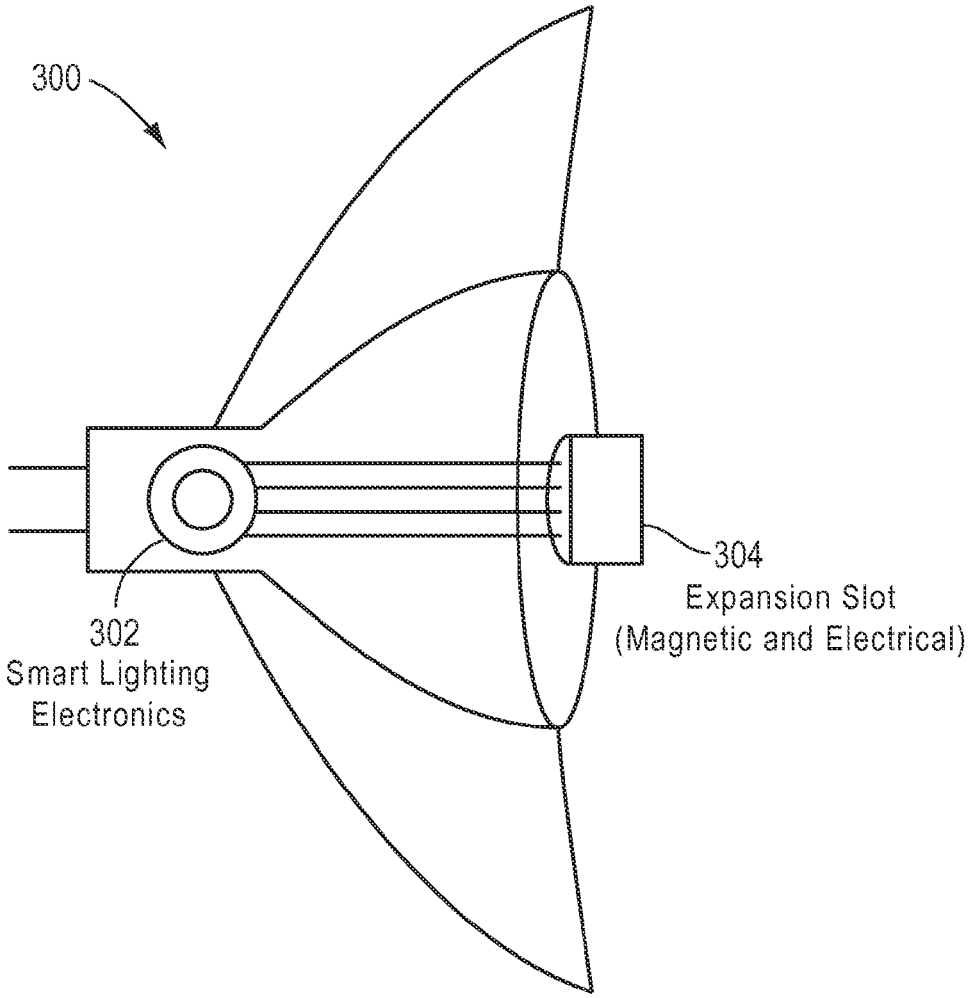
FIG. 3 shows superimposed profile shapes found in a range of lamp standards adapted to be used for providing active accessories in an LED lamp, according to some embodiments.

FIG. 3 shows superimposed profile shapes 300 found in a range of lamp standards adapted to be used for providing active accessories in an LED lamp. FIG. 3 also shows smart light electronics 302 electrically connected to an adapter within expansion slot 304.

A home or business may have several lamp types installed. Creating a set of smart accessories that fit any/all of these lamp types, and communicate with each other and with a central computer, in a consistent manner enables the consumer or business owner to monitor and control their environment efficiently and effectively. The accessories can have unique identifications and communicate with each other and a central computer using standard protocols such as uPnP, DLNA, or other interoperable or interoperability protocols. By using an expandable approach (e.g., using smart buttons versus a pre-integrated one that has the smarts built into each lamp) allows the lamps to be integrated into any operational environment of building management systems or smart lighting systems using a choice of smart buttons, and without having to replace the lamps.

Figure 4:
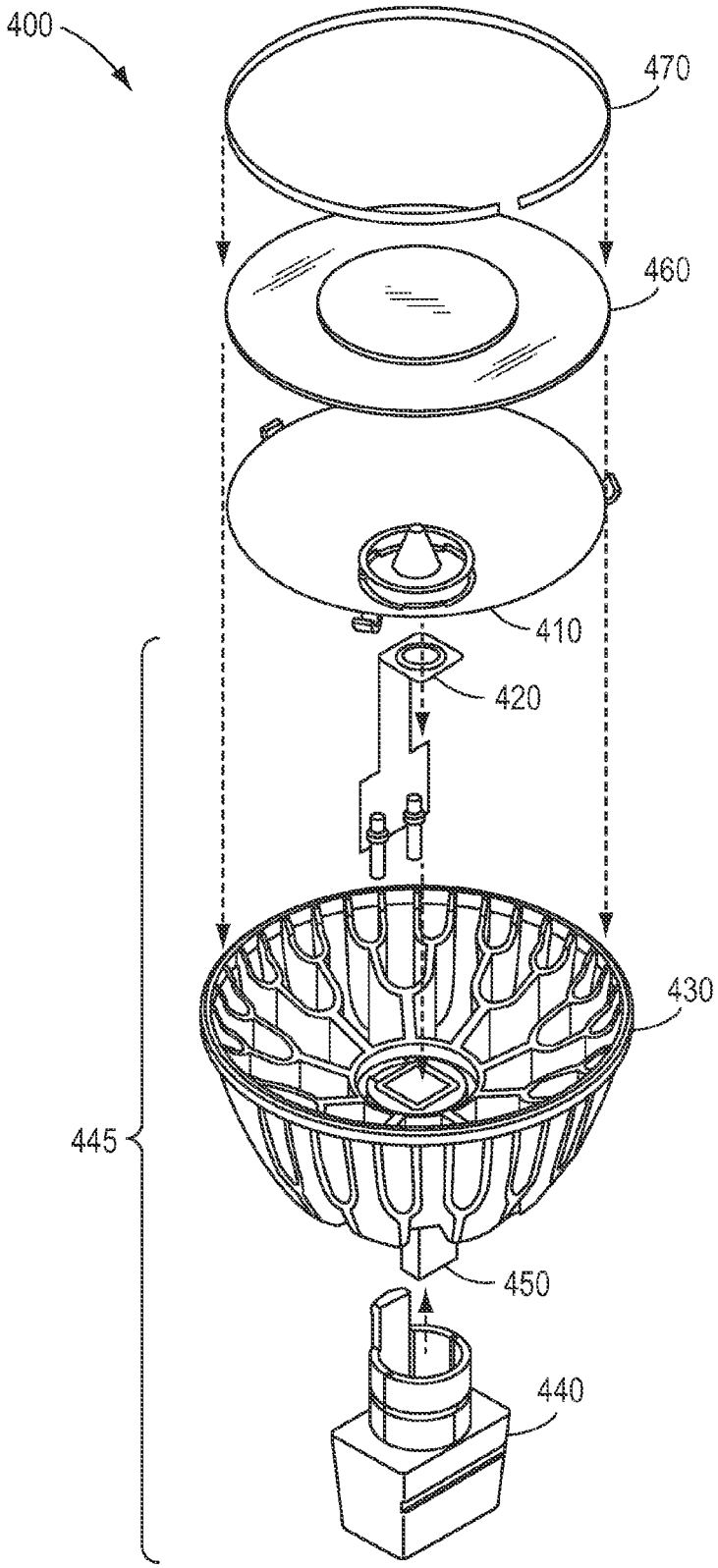
FIG. 4 shows an exploded view of an assembly found in a range of lamp standards adapted to be used for providing active accessories in an LED lamp, according to some embodiments.

FIG. 4 show san exploded view of an assembly 400 found in a range of lamp standards adapted to be used for providing active accessories in an LED lamp. The LED lamp includes a base 440, a plug 450, a heat sink 430, a circuit including the LED 420, retaining ring 410, optic 460, and retaining ring 470.

Figure 5:
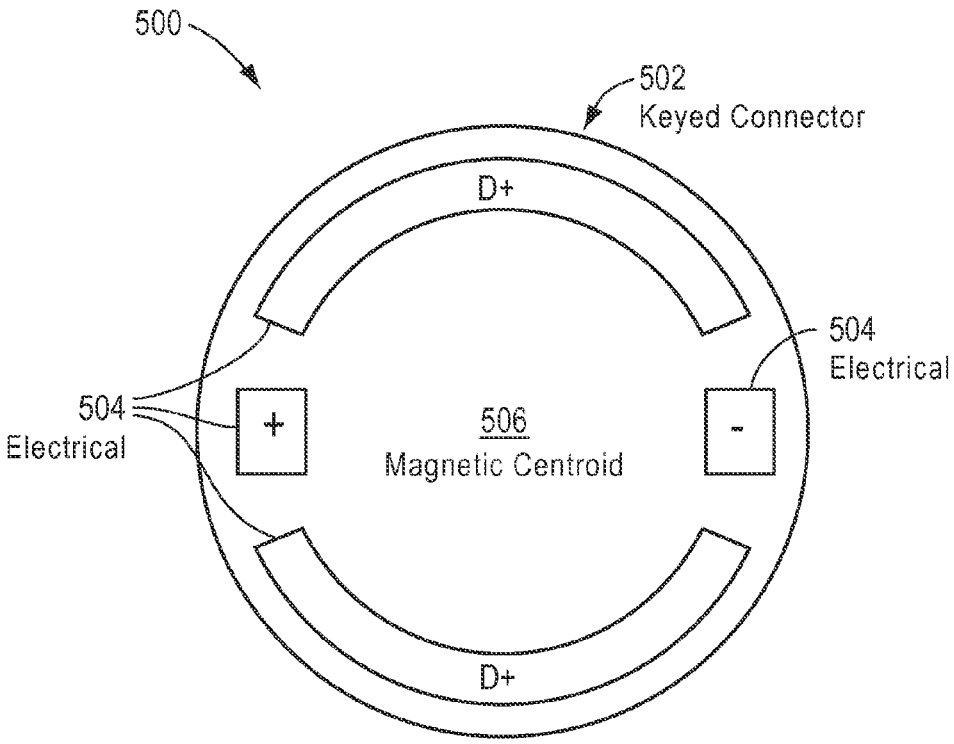
FIG. 5 shows a top view of a hybrid connector adapted to be used for providing active accessories in an LED lamp, according to some embodiments.

FIG. 5 shows a top view of a hybrid connector 500 adapted to be used for providing active accessories in an LED lamp. The adaptor includes electrical contacts 504, a keyed connector 502, and a magnetic centroid 506.

A standard interface like USB can be implemented using a simple connector with 4 or 5 terminals that carry power and data. USB provides the opportunity to leverage the vast ecosystem of systems and devices that have been built for the past few decades for PCs, CE devices, smartphones, etc., as well as the continuous evolution of the interface to accommodate new usages for consumers and businesses.

Figure 6:
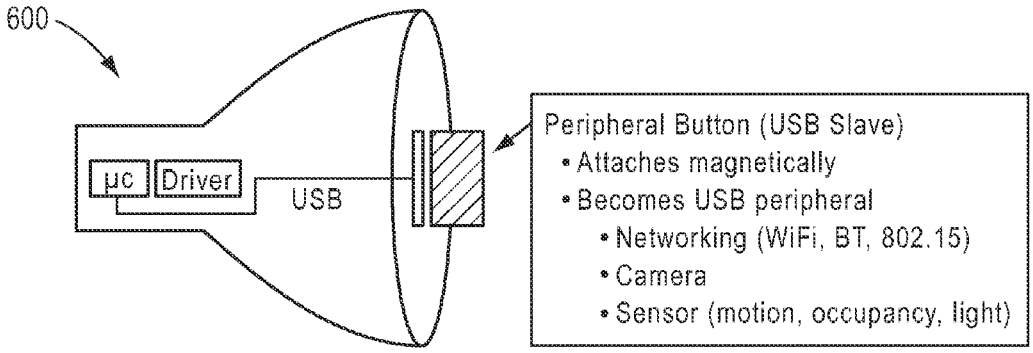
FIG. 6 shows a side view of a hybrid connector adapted to be used as a USB slave device for providing active accessories in an LED lamp, according to some embodiments.

FIG. 6 shows a side view of a hybrid connector 600 adapted to be used as a USB slave device for providing active accessories in an LED lamp.

A lamp can be built with a standard microcontroller or microprocessor with associated software, and with or without persistent connectivity to other devices or a central computer. The microcontroller or microprocessor can be used for internal lamp functions like controlling the LED driver, storing operational data like hours of usage, current and temperature data, etc. By attaching a smart USB Slave button, the functionality of the lamp can be extended to include wireless communication to other lamps and a central computer for lamp monitoring and control, connection to peripheral devices like a camera and sensors.

Figure 7:
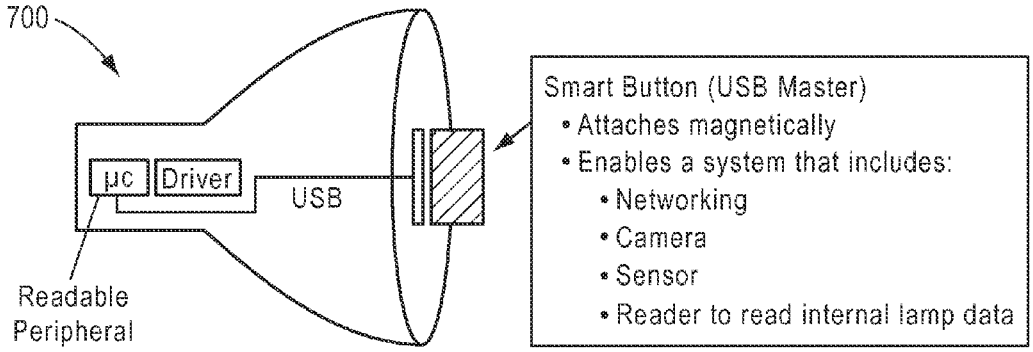
FIG. 7 shows a side view of a hybrid connector adapted to be used as a USB master device for providing active accessories in an LED lamp, according to some embodiments.

FIG. 7 shows a side view of a hybrid connector 700 adapted to be used as a USB master device for providing active accessories in an LED lamp.

A lamp can be built with even without a microcontroller or microprocessor, yet supporting a simple USB-based readable storage that stores operational data of the lamp like hours of usage, current and temperature data, etc. Once a smart USB Master button that has a microcontroller or microprocessor is connected to the lamp, that USB device can be read by the microcontroller or microprocessor on the smart button. The smart button can also integrate wireless networking to implement lamp monitoring and control, and can communicate with other lamps and/or can communicate with a central computer. It may also contain a camera and/or other sensors.

Figure 8:
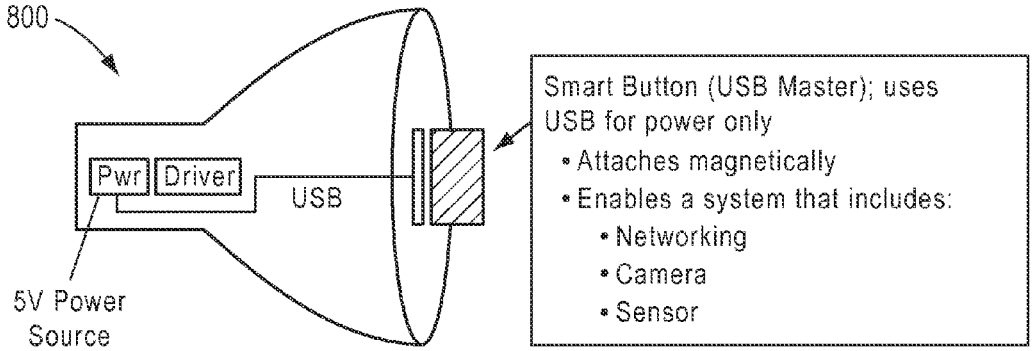
FIG. 8 shows a side view of a hybrid connector adapted to be used as power-delivery device for providing active accessories in an LED lamp, according to some embodiments.

FIG. 8 shows a side view of a hybrid connector 800 adapted to be used as power-delivery device for providing active accessories in an LED lamp.

A lamp can be built with a device that provides power to the smart button connector. When a smart USB Master button that has a microcontroller or microprocessor is connected to the lamp, the lamp can be turned into a smart lamp. The smart button can integrate wireless networking to implement lamp monitoring and control, and communication with other lamps and a central computer. It may also contain a camera and sensors. It may also contain readable storage that stores operational data of the lamp such as hours of usage, current and temperature data, etc.

Figure 9:
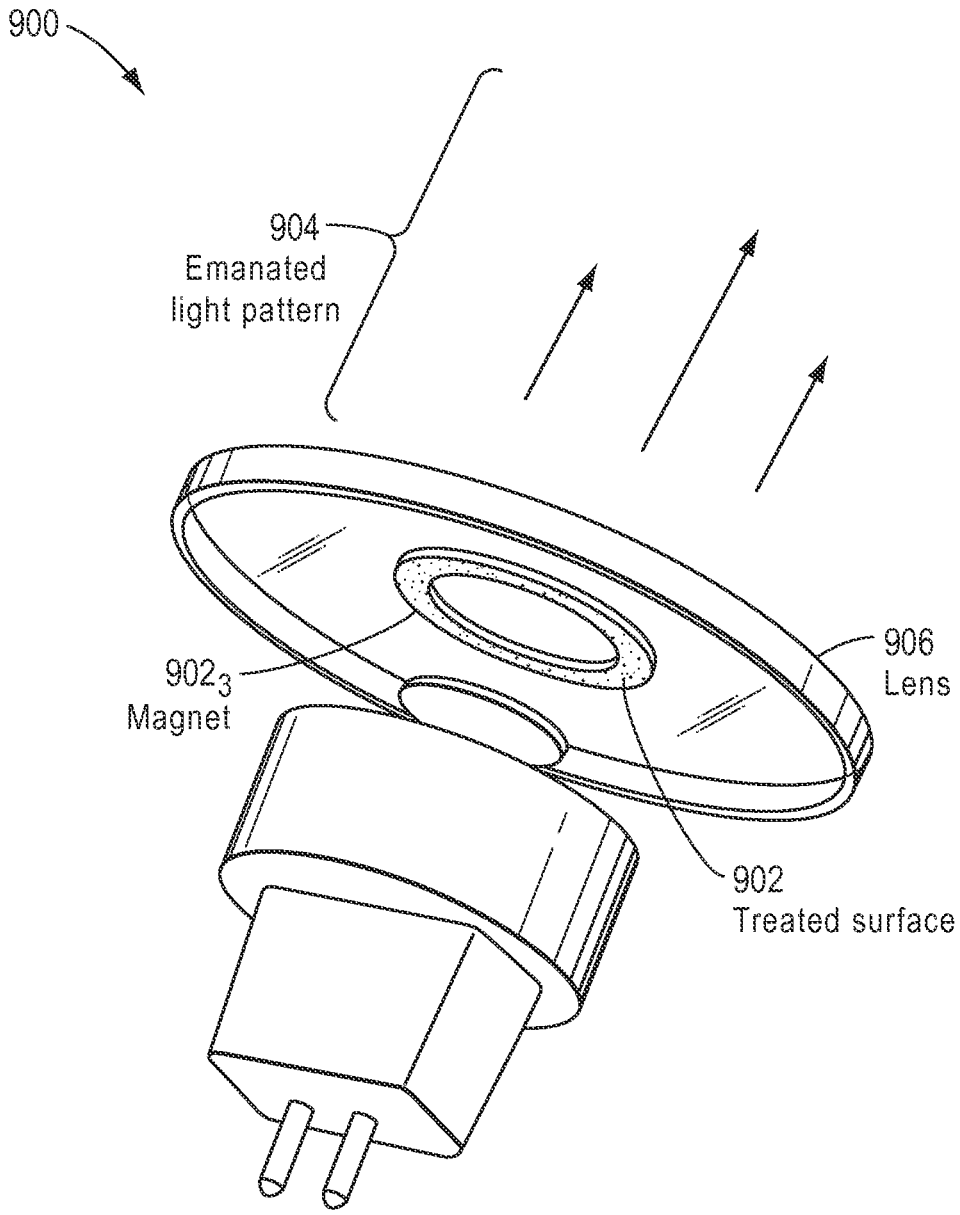
FIG. 9 shows an exploded view of an assembly found in a range of lamp standards adapted to be used for providing active accessories in an LED lamp, according to some embodiments.

FIG. 9 shows an exploded view of an assembly 900 found in a range of lamp standards adapted to be used for providing active accessories in an LED lamp. The LED lamp includes a magnet $\mathbf{902}_3$, having a treated surface 902, a lens, and an emanated light pattern 904.

One embodiment disposes accessories on the face of the lamp, in a proximity that is thermally isolated from the heat source and high temperatures of the LED. In certain embodiments, the face of the lamp is open to the environment so as to facilitate heat dissipation of any electronics. Such a face-mounting further facilitates antenna placement (e.g., for wireless radio operation), and for camera and sensor operation. It also makes it easy to connect and disconnect accessories.

In certain embodiments, an LED lamp comprises a lens having a center and a diameter; a first magnet attached to the center of the lens; a first accessory disposed on the lens; and a second magnet attached to the center of the first accessory; wherein the first magnet and the second magnet are configured to retain the first accessory against the lens.

Figure 10A:
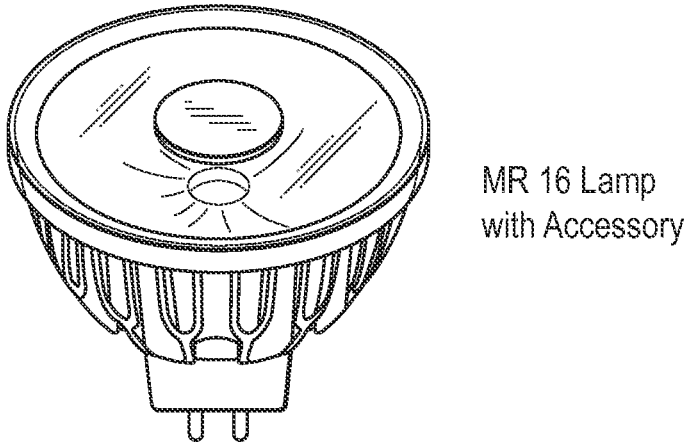
FIG. 10A depicts an assembled LED lamp with an accessory according to some embodiments.

FIG. 10A depicts an LED lamp with an accessory as an exemplary system having improved accessories for LED lamps.

Figure 10B:
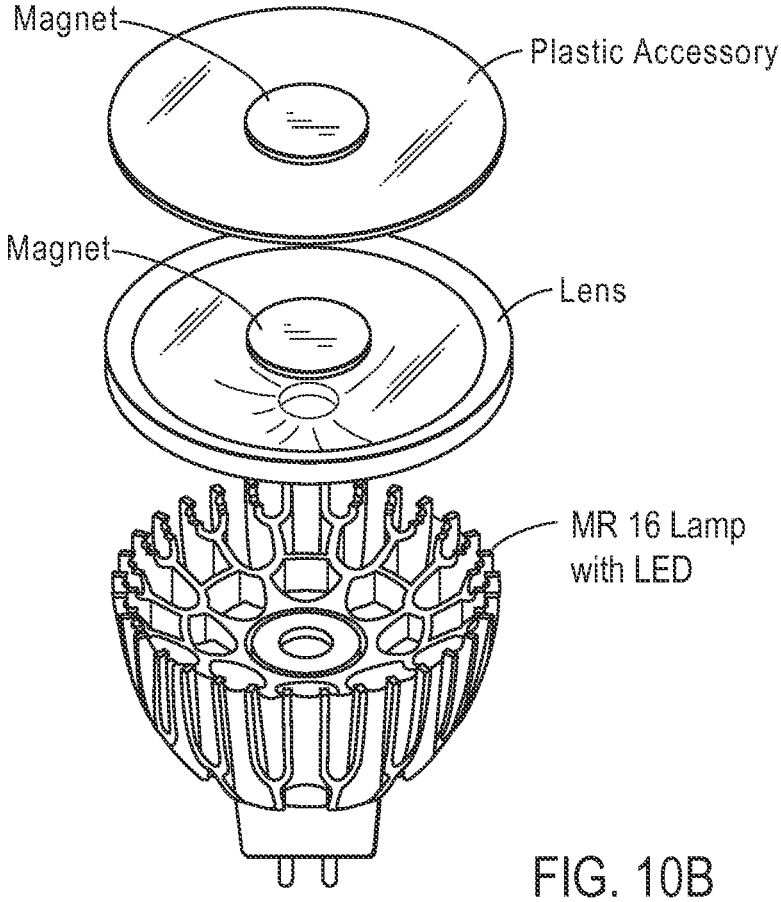
FIG. 10B shows an exploded view of an LED lamp with an accessory according to some embodiments.

FIG. 10B shows an exploded view of an LED lamp with an accessory in a system having improved accessories for LED lamps.

FIGS. 10A and 10B show an example of an LED lamp having an MR16 form factor including a heat sink. A lens is attached to the heat sink or other part of the lamp. In certain embodiments, the lens comprises a folded total internal reflection lens. Attachment may be mechanically such as using prongs as shown in FIGS. 10A and 10B. A magnet is attached to the center of the lens. An accessory having a magnet attached to the center can be disposed over the lens and the opposing magnets can hold the accessory to the lens. The first and second opposing magnets can be configured to retain the accessory against the perimeter of the lens. For example, the opposing magnets may have the opposite polarity. The accessory may have substantially the same diameter as the lens, and in certain embodiments covers an optical region of the lens, such as for example greater than 90% of the optical aperture of the LED lamp. In certain embodiments, the accessory comprises a transparent film such as for example a plastic film. In certain embodiments, the accessory is selected from a diffuser, a color filter, a polarizer, a linear dispersion element, a baffle, and a combination of any of the foregoing. In certain embodiments, the first magnet and the first accessory have a combined thickness less than about 3 mm, less than about 2 mm, less than about 1 mm, less than about 0.5 mm, and in certain embodiments, less than about 0.25 mm.

Figure 11:
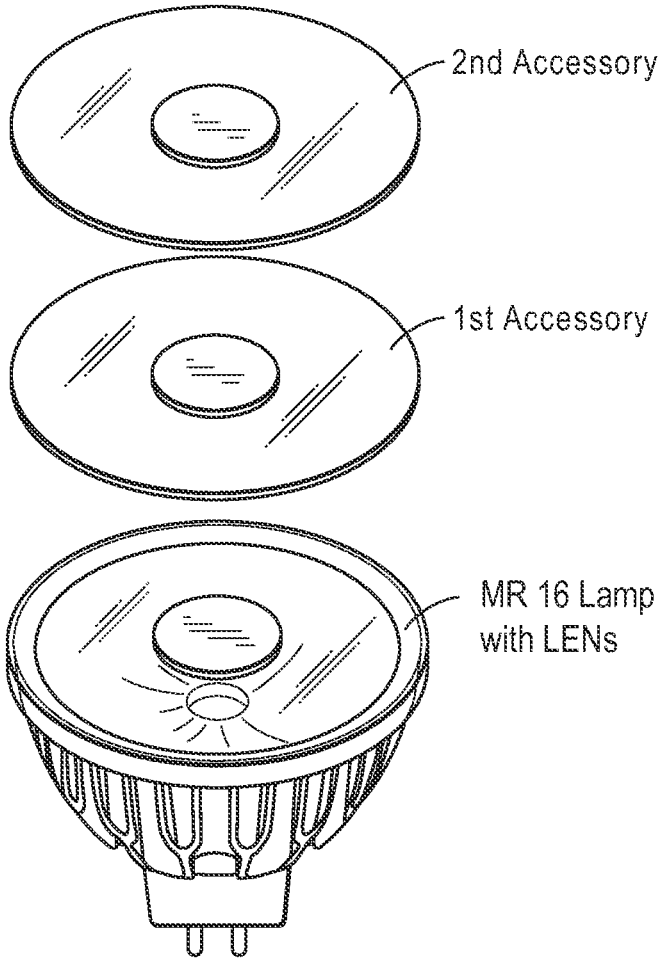
FIG. 11 shows an exploded view of an LED lamp with multiple accessories, according to some embodiments.

FIG. 11 shows an exploded view of an LED lamp with multiple accessories in a system having improved accessories for LED lamps.

In certain embodiments as shown in FIG. 11, an LED lamp comprises a second accessory disposed adjacent a first accessory. In certain embodiments, a second magnet is attached to the center of the second accessory and is used to affix the second accessory to the lamp. In certain embodiments wherein the lamp comprises a second accessory, a magnet is not attached to the center of the first accessory.

There are many configurations of LED lamps beyond the depicted MR-16 lamp. For example, Table 1 gives standards (see "Designation") and corresponding characteristics.

TABLE 1

| Designation | Base Diameter (crest of thread) | Name | IEC 60061-1 Standard Sheet |
|---|---|---|---|
| | 5 mm | Lilliput Edison Screw (LES) | 7004-25 |
| E10 | 10 mm | Miniature Edison Screw (MES) | 7004-22 |
| E11 | 11 mm | Mini-Candelabra Edison Screw (mini-can) | (7004-6-1) |
| E12 | 12 mm | Candelabra Edison Screw (CES) | 7004-28 |
| E14 | 14 mm | Small Edison Screw (SES) | 7004-23 |
| E17 | 17 mm | Intermediate Edison Screw (IES) | 7004-26 |
| E26 | 26 mm | [Medium] (one-inch) Edison Screw (ES or MES) | 7004-21A-2 |
| E27 | 27 mm | [Medium] Edison Screw (ES) | 7004-21 |
| E29 | 29 mm | [Admedium] Edison Screw (ES) | |
| E39 | 39 mm | Single-contact (Mogul) Giant Edison Screw (GES) | 7004-24-A1 |
| E40 | 40 mm | (Mogul) Giant Edison Screw (GES) | 7004-24 |

Additionally, a base member (e.g., shell, casing, etc.) can be of any form factor configured to support electrical connections, which electrical connections can conform to any of a set of types or standards. For example, Table 2 gives standards (see "Type") and corresponding characteristics, including mechanical spacings.

TABLE 2

| Type | Standard | Pin (center to center) | Pin Diameter | Usage |
|---|---|---|---|---|
| G4 | IEC 60061-1 (7004-72) | 4.0 mm | 0.65-0.75 mm | MR11 and other small halogens of 5/10/20 watt and 6/12 volt |
| GU4 | IEC 60061-1 (7004-108) | 4.0 mm | 0.95-1.05 mm | |
| GY4 | IEC 60061-1 (7004-72A) | 4.0 mm | 0.65-0.75 mm | |
| GZ4 | IEC 60061-1 (7004-64) | 4.0 mm | 0.95-1.05 mm | |
| G5 | IEC 60061-1 (7004-52-5) | 5 mm | | T4 and T5 fluorescent tubes |
| G5.3 | IEC 60061-1 (7004-73) | 5.33 mm | 1.47-1.65 mm | |
| G5.3-4.8 | IEC 60061-1 (7004-126-1) | | | |
| GU5.3 | IEC 60061-1 (7004-109) | 5.33 mm | 1.45-1.6 mm | |
| GX5.3 | IEC 60061-1 (7004-73A) | 5.33 mm | 1.45-1.6 mm | MR16 and other small halogens of 20/35/50 watt and 12/24 volt |
| GY5.3 | IEC 60061-1 (7004-73B) | 5.33 mm | | |
| G6.35 | IEC 60061-1 (7004-59) | 6.35 mm | 0.95-1.05 mm | |
| GX6.35 | IEC 60061-1 (7004-59) | 6.35 mm | 0.95-1.05 mm | |
| GY6.35 | IEC 60061-1 (7004-59) | 6.35 mm | 1.2-1.3 mm | Halogen 100 W 120 V |
| GZ6.35 | IEC 60061-1 (7004-59A) | 6.35 mm | 0.95-1.05 mm | |
| G8 | | 8.0 mm | | Halogen 100 W 120 V |
| GY8.6 | | 8.6 mm | | Halogen 100 W 120 V |
| G9 | IEC 60061-1 (7004-129) | 9.0 mm | | Halogen 120 V (US)/230 V (EU) |
| G9.5 | | 9.5 mm | 3.10-3.25 mm | Common for theatre use, several variants |
| GU10 | | 10 mm | | Twist-lock 120/230-volt MR16 halogen lighting of 35/50 watt, since mid-2000s |
| G12 | | 12.0 mm | 2.35 mm | Used in theatre and single-end metal halide lamps |
| G13 | | 12.7 mm | | T8 and T12 fluorescent tubes |
| G23 | | 23 mm | 2 mm | |
| GU24 | | 24 mm | | Twist-lock for self-ballasted compact fluorescents, since 2000s |
| G38 | | 38 mm | | Mostly used for high-wattage theatre lamps |

TABLE 2-continued

| Type | Standard | Pin (center to center) | Pin Diameter | Usage |
|---|---|---|---|---|
| GX53 | | 53 mm | | Twist-lock for puck-shaped under-cabinet compact fluorescents, since 2000s |

Additionally, a lens may comprise a bulb or remote member used in forming the LED lamp. The aspect of a center can mean a center from the perspective of any center, or even a centroid (from any view) as in the case of an irregularly shaped lens.

Accessories and methods of attached accessories disclosed herein may be used with any suitable LED lamp configuration such as any of those disclosed in Table 1.

Finally, it should be noted that there are alternative ways of implementing the embodiments disclosed herein. Accordingly, the present embodiments are to be considered as illustrative and not restrictive, and the claims are not to be limited to the details given herein, but may be modified within the scope and equivalents thereof.

What is claimed is:

1. A light emitting diode (LED) lamp comprising:

a lens having a center and a diameter;

a first magnet attached to the center of the lens;

a first accessory having a center, wherein the first accessory is disposed on the lens; and a second magnet attached to the center of the first accessory;

wherein the first magnet and the second magnet are configured to retain the first accessory against the lens.

2. The LED lamp of claim 1, wherein the first accessory comprises a thin plastic film.

3. The LED lamp of claim 1, wherein the first magnet and the second magnet are configured to retain the first accessory against a perimeter of the lens.

4. The LED lamp of claim 1, wherein the first accessory has a diameter that is substantially the same as the diameter of the lens.

5. The LED lamp of claim 1, wherein the first accessory has a diameter that is the same as the diameter of the lens.

6. The LED lamp of claim 1, wherein the first accessory has a diameter that substantially covers an optical region of the lens.

7. The LED lamp of claim 1, wherein the lens is configured to attach to an MR16 lamp.

8. The LED lamp of claim 1, wherein the first accessory is selected from a diffuser, a color filter, a polarizer, a linear dispersion element, a baffle, and a combination of any of the foregoing.

9. The LED lamp of claim 1, wherein the first magnet and the first accessory have a combined thickness less than 1 mm.

10. The LED lamp of claim 1, wherein the lens comprises a folded total internal reflection lens.

11. The LED lamp of claim 1, wherein the lamp is characterized by a lamp output mechanical aperture; and the lens is configured to cover more than 90% of the lamp output mechanical aperture.

12. The LED lamp of claim 1, comprising a second accessory having a center, wherein the second accessory is disposed adjacent the first accessory.

13. The LED lamp of claim 12, wherein second accessory comprises a third magnet, wherein the third magnet is attached to the center of the second accessory.

14. An apparatus for providing active accessories in a light emitting diode (LED) lamp, comprising:

an LED illumination product having a lens and a housing;

at least one electronic component disposed within the housing; and at least two electrical conductors electrically-connected to the at least one electrical component, the at least two electrical conductors disposed within a rigid member affixed to the lens.

15. The apparatus of claim 14, wherein the rigid member accepts a USB connector.

16. The apparatus of claim 14, wherein the rigid member is made of a magnetic material.

17. The apparatus of claim 14, wherein the rigid member is affixed to the lens with an adhesive.

18. The apparatus of claim 14, wherein the rigid member is affixed to the lens with a mechanical connector.

* * * * *